US012178260B2

(12) United States Patent
Talbot et al.

(10) Patent No.: US 12,178,260 B2
(45) **Date of Patent: *Dec. 31, 2024**

(54) SMOKING SUBSTITUTE DEVICE AND SYSTEM FOR MANAGING A SMOKING SUBSTITUTE DEVICE

(71) Applicant: Imperial Tobacco Limited, Bristol (GB)

(72) Inventors: Oliver Talbot, Liverpool (GB); Thomas Sudlow, Liverpool (GB); Jonathan Marchbank, Liverpool (GB); Daniel Harden, San Jose, CA (US); Britt Jensen, San Jose, CA (US); Brian Leach, San Jose, CA (US)

(73) Assignee: IMPERIAL TOBACCO LIMITED, Bristol (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/237,457

(22) Filed: Aug. 24, 2023

(65) Prior Publication Data

US 2023/0389619 A1 Dec. 7, 2023

Related U.S. Application Data

(63) Continuation of application No. 17/006,556, filed on Aug. 28, 2020, now Pat. No. 11,771,141.

(60) Provisional application No. 62/893,709, filed on Aug. 29, 2019.

(30) Foreign Application Priority Data

Sep. 11, 2019 (EP) ..... 19196743

(51) Int. Cl.

| | |
|---|---|
| ***A24F 13/00*** | (2006.01) |
| ***A24F 40/51*** | (2020.01) |
| ***A24F 40/53*** | (2020.01) |
| ***A24F 40/60*** | (2020.01) |
| ***A24F 40/90*** | (2020.01) |

(52) U.S. Cl.

CPC ..... *A24F 40/90* (2020.01); *A24F 40/51* (2020.01); *A24F 40/53* (2020.01); *A24F 40/60* (2020.01)

(58) Field of Classification Search

CPC ..... A24F 47/00
USPC ..... 131/328–329
See application file for complete search history.

(56) References Cited

U.S. PATENT DOCUMENTS 11,771,141 B2 * 10/2023 Talbot ..... A24F 40/53 131/329
2023/0007735 A1 * 1/2023 Hatton ..... A24F 40/50

* cited by examiner

*Primary Examiner* — Abdullah A Riyami
(74) *Attorney, Agent, or Firm* — J. Miguel Hernandez; James R. Gourley; Carstens, Allen & Gourley, LLP

(57) ABSTRACT

A smoking substitute device having: a control unit; a battery configured to supply power to the smoking substitute device; a movement sensing component configured to sense movement of the smoking substitute device; and a battery level indicator configured to, when activated, provide an indication of charge remaining in the battery. The control unit is configured to activate the battery level indicator when a predetermined movement of the smoking substitute device is detected using the movement sensing component.

19 Claims, 8 Drawing Sheets

SMOKING SUBSTITUTE DEVICE AND SYSTEM FOR MANAGING A SMOKING SUBSTITUTE DEVICE

CROSS REFERENCE TO RELATED APPLICATION

This application is a continuation application of co-pending U.S. application Ser. No. 17/006,556 entitled "Smoking Substitute Device and System for Managing a Smoking Substitute Device" filed on Aug. 28, 2020. Co-pending U.S. application Ser. No. 17/006,556 claims the benefit of provisional U.S. Application No. 62/893,709 entitled "Smoking Substitute Device" filed Aug. 29, 2019, and also claims priority to EP Application No. EP19196743.9 filed Sep. 11, 2019. The technical disclosures of each application is hereby incorporated by reference in their entirety.

TECHNICAL FIELD

The present invention relates to a smoking substitute device and to a system including a smoking substitute device.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Conventional combustible smoking articles, such as cigarettes, typically comprise a cylindrical rod of tobacco comprising shreds of tobacco which is surrounded by a wrapper, and usually also a cylindrical filter axially aligned in an abutting relationship with the wrapped tobacco rod. The filter typically comprises a filtration material which is circumscribed by a plug wrap. The wrapped tobacco rod and the filter are joined together by a wrapped band of tipping paper that circumscribes the entire length of the filter and an adjacent portion of the wrapped tobacco rod. A conventional cigarette of this type is used by lighting the end opposite to the filter, and burning the tobacco rod. The smoker receives mainstream smoke into their mouth by drawing on the mouth end or filter end of the cigarette.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices may comprise electronic systems that permit a user to simulate the act of smoking by producing an aerosol (also referred to as a "vapour") that is drawn into the lungs through the mouth (inhaled) and then exhaled. The inhaled aerosol typically bears nicotine and/or flavourings without, or with fewer of, the odour and health risks associated with traditional smoking.

In general, smoking substitute devices are intended to provide a substitute for the rituals of smoking, whilst providing the user with a similar experience and satisfaction to those experienced with traditional smoking and tobacco products. Some smoking substitute systems use smoking substitute articles (also referred to as a "consumables") that are designed to resemble a traditional cigarette and are cylindrical in form with a mouthpiece at one end.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilising a different smoking substitute approach. A smoking substitute approach corresponds to the manner in which the substitute system operates for a user.

One approach for a smoking substitute device is the so-called "vaping" approach, in which a vapourisable liquid, typically referred to (and referred to herein) as "e-liquid", is heated by a heating device to produce an aerosol vapour which is inhaled by a user. An e-liquid typically includes a base liquid as well as nicotine and/or flavourings. The resulting vapour therefore typically contains nicotine and/or flavourings. The base liquid may include propylene glycol and/or vegetable glycerin.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapour") which is inhaled by a user through the mouthpiece.

Vaping smoking substitute devices can be configured in a variety of ways. For example, there are "closed system" vaping smoking substitute devices which typically have a sealed tank and heating element which is pre-filled with e-liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e-cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the heating device, which heats e-liquid from the tank to produce a vapour which is inhaled by a user through the mouthpiece.

Another example vaping smoking substitute device is the blu PRO™ e-cigarette. The blu PRO™ e-cigarette is an open system device which includes a main body, a (refillable) tank, and a mouthpiece. The main body and tank are physically and electrically coupled together by screwing one to the other. The mouthpiece and refillable tank are physically coupled together by screwing one of the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapour which is inhaled by a user through the mouthpiece.

Another approach for a smoking substitute system is the so-called Heated Tobacco ("HT") approach in which tobacco (rather than an "e-liquid") is heated or warmed to release vapour. HT is also known as "heat not burn" ("HNB"). The tobacco may be leaf tobacco or reconstituted tobacco. The vapour may contain nicotine and/or flavourings. In the HT approach the intention is that the tobacco is heated but not burned, i.e. the tobacco does not undergo combustion.

A typical HT smoking substitute system may include a device and a consumable. The consumable may include the tobacco material. The device and consumable may be configured to be physically coupled together. In use, heat may be imparted to the tobacco material by a heating element of the device, wherein airflow through the tobacco material causes components in the tobacco material to be released as vapour. A vapour may also be formed from a carrier in the tobacco material (this carrier may for example include propylene glycol and/or vegetable glycerine) and additionally volatile compounds released from the tobacco. The released vapour may be entrained in the airflow drawn through the tobacco.

As the vapour passes through the consumable (entrained in the airflow) from the location of vaporisation to an outlet of the consumable (e.g. a mouthpiece), the vapour cools and condenses to form an aerosol for inhalation by the user. The aerosol will normally contain the volatile compounds.

In HT smoking substitute systems, heating as opposed to burning the tobacco material is believed to cause fewer, or smaller quantities, of the more harmful compounds ordinarily produced during smoking. Consequently, the HT approach may reduce the odour and/or health risks that can arise through the burning, combustion and pyrolytic degradation of tobacco.

There may be a need for improved design of smoking substitute systems, in particular HT smoking substitute systems, to enhance the user experience and improve the function of the HT smoking substitute system.

An example of the HT approach is the IQOS™ smoking substitute device from Philip Morris Ltd. The IQOS™ smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapour and flavourings which may be drawn through the mouthpiece by the user through inhalation.

A second example of the HT approach is the device known as "Glo" ™ from British American Tobacco p.l.c. Glo™ comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapour and flavourings which may be drawn through the consumable by the user through inhalation. The tobacco, when heated by the heating device, is configured to produce vapour when heated rather than when burned (as in a smoking apparatus, e.g. a cigarette). The tobacco may contain high levels of aerosol formers (carrier), such as vegetable glycerine ("VG") or propylene glycol ("PG").

The present inventor(s) have observed that most smoking substitute devices currently on the market are configured to operate in isolation of other devices, which limits the functions the smoking substitute devices can perform.

The present invention has been devised in light of the above considerations.

SUMMARY OF THE INVENTION

In a first aspect, the present invention provides a smoking substitute device having:

- a control unit;
- a battery configured to supply power to the smoking substitute device;
- a movement sensing component configured to sense movement of the smoking substitute device; and
- a battery level indicator configured to, when activated, provide an indication of charge remaining in the battery;
- wherein the control unit is configured to activate the battery level indicator when a predetermined movement of the smoking substitute device is detected using the movement sensing component.

In this way, a user can obtain an indication of charge remaining in the battery when needed (by performing the predetermined movement), whilst avoiding using up battery by providing the visual indication when the user does not need an indication of charge remaining in the battery.

Preferably, the control unit is configured to activate the battery level indicator for no more than a predetermined length of time, when the predetermined movement of the smoking substitute device is detected using the movement sensing component.

In this way, a user can obtain an indication of charge remaining in the battery when needed (by performing the predetermined movement), whilst avoiding using up battery by providing the indication when the user does not need an indication of charge remaining in the battery.

The predetermined length of time may be 30 seconds or less, 20 seconds or less, 10 seconds or less, or 5 seconds or less, for example.

However, it is not a requirement of the invention for the control unit is configured to activate the battery level indicator for no more than a predetermined length of time (when the predetermined movement of the smoking substitute device is detected using the movement sensing component).

For example, instead of the control unit being configured to activate the battery level indicator for no more than a predetermined length of time (when the predetermined movement of the smoking substitute device is detected using the movement sensing component), the control unit could instead be configured to activate the battery level indicator until a further predetermined moved of the smoking substitute device is detected using the movement sensing component (at which point the battery level indicator could be deactivated). The further predetermined movement could be the same as the predetermined movement, or different to the predetermined movement.

Preferably, the movement sensing component includes at least one accelerometer.

Preferably, the predetermined movement detected using the movement sensing component includes a tap of the smoking substitute device (e.g. tapping the smoking substitute device against a surface), and preferably includes sequence of taps of the smoking substitute device (e.g. a double tap).

For example, the predetermined movement detected using the movement sensing component detected using the movement sensing component may include a sequence of taps of the smoking substitute device performed within a predetermined "tap sequence" length of time (e.g. within 1 second). For example, the predetermined movement may include a double tap, wherein the two taps of the double tap are performed within a predetermined "tap sequence" length of time (e.g. within 1 second).

In some embodiments, the battery level indicator may be configured to, when activated, provide a haptic indication of charge remaining in the battery. For example, the battery level indicator may be configured to, when activated, provide a haptic indication by causing the smoking substitute device to vibrate a number of times, wherein the number of distinct vibrations provides an indication of charge remaining in the battery.

In some embodiments, the battery level indicator may be configured to, when activated, produce sound which provides an audible indication of charge remaining in the battery. For example, the battery level indicator may be configured to, when activated, produce sound which indicates charge remaining in the battery, e.g. by producing words which indicates charge remaining in battery (e.g. "50% charge") or by producing a number of sounds (e.g. beeps), wherein the number of distinct sounds produced provides an indication of charge remaining in the battery.

Whilst haptic and audible indications are possible, preferably the indication is visual.

That is, preferably, the battery level indicator is configured to, when activated, provide a visual indication of charge remaining in the battery.

Preferably, the battery level indicator is configured to, when activated, provide an indication of charge remaining in the battery by operating in one of a plurality of indication states, wherein each indication state corresponds to a different amount of charge remaining in the battery.

Preferably, the control unit is configured to activate the battery level indicator to provide one of the plurality of indication states for no more than the predetermined length of time, when a predetermined movement of the smoking substitute device is detected using the movement sensing component.

For example, each indication state could involve the battery level indicator causing the smoking substitute device to vibrate a different number of times (haptic indication of charge remaining), produce a different number of sounds (audible indication of charge remaining) or light up a different number of lights (visual indication of charge remaining).

For avoidance of any doubt, the amount of charge remaining in the battery indicated by each indication state could cover a range of charges.

In some embodiments, each indication state may correspond to a different (respective) estimated number of remaining activations that can be performed by the smoking substitute device before the smoking substitute device becomes inoperable due to a lack of battery charge.

Preferably, the battery level indicator is configured to, when activated, provide a visual indication of charge remaining in the battery by operating in one of a plurality of visual indication states, wherein each visual indication state corresponds to a different amount of charge remaining in the battery.

Preferably, the control unit is configured to activate the battery level indicator to provide one of the plurality of visual indication states for no more than the predetermined length of time, when a predetermined movement of the smoking substitute device is detected using the movement sensing component.

For avoidance of any doubt, the amount of charge remaining in the battery indicated by each visual indication state could cover a range of charges.

In some embodiments, each visual indication state may correspond to a different (respective) estimated number of remaining activations that can be performed by the smoking substitute device before the smoking substitute device becomes inoperable due to a lack of battery charge.

Herein, an activation of the smoking substitute device may be defined as the smoking substitute device being operated to produce vapour. As explained below, such an activation may occur, for example, when an actuator included in the smoking substitute device is actuated by a user of the device, or when a user inhaling through a mouthpiece of the device, e.g. as described further herein.

For avoidance of any doubt, the estimated number of remaining activations indicated by each (e.g. visual) indication state could cover a range of numbers.

For example, a first (e.g. visual) indication state could correspond to a first estimated number of (e.g. 200 or more) remaining activations, a second (e.g. visual) indication state could correspond to a second estimated number of (e.g. 80 or more) remaining activations, a third (e.g. visual) indication state could correspond to a third estimated number of (e.g. 30 or more) remaining activations, and a fourth (e.g. visual) indication state could correspond to a fourth estimated number of (e.g. no more than 10) remaining activations.

For avoidance of any doubt, it is noted that an "estimated number of remaining activations that can be performed by the smoking substitute device before the smoking substitute device becomes inoperable due to a lack of battery charge" should be viewed as equating to an indication of charge remaining in the battery, since the estimated number of remaining activations will typically correlate with the amount of charge remaining.

Preferably, the control unit is configured to obtain one or more measurements indicative of charge remaining in the battery, and to select an (e.g. visual) indication state to be provided by the battery level indicator (when activated by the control unit) based on the one or more measurements.

Measurements indicative of charge remaining in a battery are well known in the art. For example, a measurement of a voltage produced by the battery is one such measurement (since charge remaining in a battery can be inferred based on the voltage produced by the battery).

Preferably, the control unit is configured such that the selection of an (e.g. visual) indication state by the control unit (based on the one or more measurements) is dependent on usage data concerning how the smoking substitute device has been used by a user of the smoking substitute device.

In this way, the (e.g. visual) indication of charge remaining in the battery provided by the battery level indicator can take account of how the smoking substitute device has actually been used by the user of the smoking substitute device.

Preferably, the control unit is configured such that the selection of an (e.g. visual) indication state by the control unit (based on the one or more measurements) uses configuration information stored on the smoking substitute device, wherein the configuration information stored on the smoking substitute device provides a relationship between one or more measurements indicative of charge remaining in the battery and the plurality of (e.g. visual) indication states.

This configuration information stored on the smoking substitute device may, for example, take the form of a look-up table configured to provide an (e.g. visual) indication state based on one or more measurements indicative of charge remaining in the battery obtained by the control unit. In a simple form, this look-up table could provide an estimated number of remaining activations for a measurement of a voltage produced by the battery as obtained by the control unit.

The configuration information stored on the smoking substitute device may be static, e.g. held in firmware. Static configuration information may have been prepared for an "average user" at the time of manufacture of the smoking substitute device.

However, preferably, the configuration information stored on the smoking substitute device is configured to be updated based on data concerning how the smoking substitute device has been used by a user of the smoking substitute device. This is a preferred technique for making the selection of an (e.g. visual) indication state by the control unit (based on the one or more measurements) dependent on usage data concerning how the smoking substitute device has been used by a user of the smoking substitute device.

For example, if each (e.g. visual) indication state corresponds to a different (respective) estimated number of remaining activations that can be performed by the smoking substitute device before the smoking substitute device becomes inoperable due to a lack of battery charge, the configuration information may be updated based on data concerning the length of time the user typically activates their smoking substitute device per activation (e.g. an average "puff length" taken by the user). In this way, the (e.g. visual) indication state provided by the battery level indicator is able to take account of how the user actually uses their device, and is thus able to provide a more accurate indication of the number of remaining activations for that user (the number of remaining activations would be higher for a user who activates their device for a relatively short amount of time per activation, and lower for a user who activates their device for a relatively long amount of time per activation).

The control unit may be configured to update the configuration information stored on the smoking substitute device based on data concerning how the smoking substitute device has been used by a user of the smoking substitute device based on an analysis (by the control unit) of data concerning how the smoking substitute device has been used by a user of the smoking substitute device.

However, preferably, the analysis of data concerning how the smoking substitute device has been used by a user of the smoking substitute device is offloaded to an application on a mobile device wirelessly connected to the smoking substitute device, which might typically have more computational power or battery life than a smoking substitute device.

Thus, preferably, the control unit is configured to update the configuration information stored on the smoking substitute device based on (e.g. by replacing the existing configuration information with) new/updated configuration information received from an application on a mobile device wirelessly connected to the smoking substitute device, wherein preferably the application on the mobile device has prepared the new/updated configuration information based on an analysis of data concerning how the smoking substitute device has been used by a user of the smoking substitute device.

Preferably, the plurality of (e.g. visual) indication states includes a low battery indication state (which could be a low battery visual indication state) indicating that there is less than a predetermined threshold amount of charge remaining in the battery (which may correspond to no more than a predetermined estimated number of remaining activations).

Preferably, the control unit is configured to, when it determines that there is less than the threshold amount of charge remaining in the battery (e.g. based on configuration information as described above), activate the battery level indicator to provide the low battery indication state (which could be a low battery visual indication state) when a user activates the smoking substitute device (e.g. when a user inhales through a mouthpiece of the device), preferably regardless of whether the predetermined movement of the smoking substitute device is not detected.

In this way, a user of the smoking substitute device can be informed of a low battery (few remaining activations) at the time of using the device, without having to perform the predetermined movement.

If the user choses to continue to activate the smoking substitute device after the low battery indication state (which could be a low battery visual indication state) has been provided (without charging the smoking substitute device), it may not be necessary and may even be an annoyance for the user for the low battery indication state to be provided every time the user activates the device whilst there is still less than a predetermined threshold amount of charge remaining in the battery. Therefore, in some examples, the control unit may be configured to only activate the battery level indicator to provide the low battery indication state once within a pre-determined time period of determining that there is less than the threshold amount of charge remaining in the battery. In such examples, if the user continues to activate the smoking substitute device during this pre-determined time period, the low battery indication state will not be provided more than once. Once the predetermined time period has elapsed, the low battery indication state may once again be provided when the user activates the device.

Preferably, the control unit is configured not to activate the battery level indicator, unless either the predetermined movement of the smoking substitute device is detected using the movement sensing component or it is determined that there is less than the threshold amount of charge remaining in the battery.

The plurality of (e.g. visual) indication states should differ from each other.

Preferably, the battery level indicator is configured to, when activated, provide a visual indication of charge remaining in the battery, and the battery level indicator includes a plurality of lights configured to provide the plurality of the visual indication states.

Each light may be configured to only be visible to a user when illuminated, e.g. by being hidden behind translucent plastic material.

If the battery level indicator includes a plurality of lights, one or more of the lights may be illuminated continuously in one or more of the visual indication states.

If the battery level indicator includes a plurality of lights, one or more of the lights may be illuminated discontinuously (i.e. turn on and off more than once during the predetermined length of time) in one or more of the visual indication states.

If the battery level indicator includes a plurality of lights, then preferably one or more of the lights is illuminated discontinuously in a low battery visual indication state, since this makes that state more noticeable to a user.

In a second aspect, the present invention provides a system for managing a smoking substitute device, the system including:

a smoking substitute device according to the first aspect of the invention; and a mobile device;

wherein the smoking substitute device is configured to communicate wirelessly with an application installed on the mobile device.

Preferably, the application is configured to display on a screen of the mobile device information concerning the battery of the smoking substitute device, based on one or more measurements indicative of charge remaining in the battery obtained by (e.g. a control unit of) the smoking substitute device that have been wirelessly communicated by the smoking substitute device to the application on the mobile device.

The information concerning the battery of the smoking substitute device displayed on the screen of the mobile device may include a battery level indication, e.g. expressed as a percentage.

The information concerning the battery of the smoking substitute device displayed on the screen of the mobile device may include an estimated number of remaining activations that can be performed by the smoking substitute device before the smoking substitute device becomes inoperable due to a lack of battery charge (e.g. expressed as "puffs left").

The estimated number of remaining activations is preferably calculated by the application in a manner that is dependent on usage data concerning how the smoking substitute device has been used by a user of the smoking substitute device, e.g. as described elsewhere herein.

The information concerning the battery of the smoking substitute device displayed on the screen of the mobile device may include an estimated amount of time remaining before the smoking substitute device becomes inoperable due to a lack of battery charge.

The estimated time remaining is preferably calculated by the application in a manner that is dependent on usage data concerning how the smoking substitute device has been used by a user of the smoking substitute device.

Preferably the application is configured to prepare new/updated configuration information (which provides a relationship between one or more measurements indicative of charge remaining in the battery to the plurality of (e.g. visual) indication states) based on an analysis of data concerning how the smoking substitute device has been used by a user of the smoking substitute device, and to send the new/updated configuration information to the smoking substitute device (which can then update the configuration information stored on the smoking substitute device based on the new/updated configuration information it receives from the application, as described previously).

Preferably, each (e.g. visual) indication state corresponds to a different (respective) estimated number of remaining activations that can be performed by the smoking substitute device before the smoking substitute device becomes inoperable due to a lack of battery charge, and the application is configured to prepare new/updated configuration information (which provides a relationship between one or more measurements indicative of charge remaining in the battery to the plurality of (e.g. visual) indication states) based on an analysis of data concerning the length of time the user typically activates their smoking substitute device per activation (e.g. an average "puff length" taken by the user). In this way, the (e.g. visual) indication state provided by the battery level indicator is able to take account of how the user actually uses their device, and is thus able to provide a more accurate indication of the number of remaining activations for that user.

The invention includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

SUMMARY OF THE FIGURES

Embodiments and experiments illustrating the principles of the invention will now be discussed with reference to the accompanying figures in which:

FIG. 2(*b*) shows the main body of the smoking substitute device of FIG. 2(*a*) without the consumable.

FIG. 2(*c*) shows the consumable of the smoking substitute device of FIG. 2(*a*) without the main body.

FIG. 3(*b*) is a schematic view of the consumable of the smoking substitute device of FIG. 2(*a*).

DETAILED DESCRIPTION OF THE INVENTION

Aspects and embodiments of the present invention will now be discussed with reference to the accompanying figures. Further aspects and embodiments will be apparent to those skilled in the art. All documents mentioned in this text are incorporated herein by reference.

Figure 1:
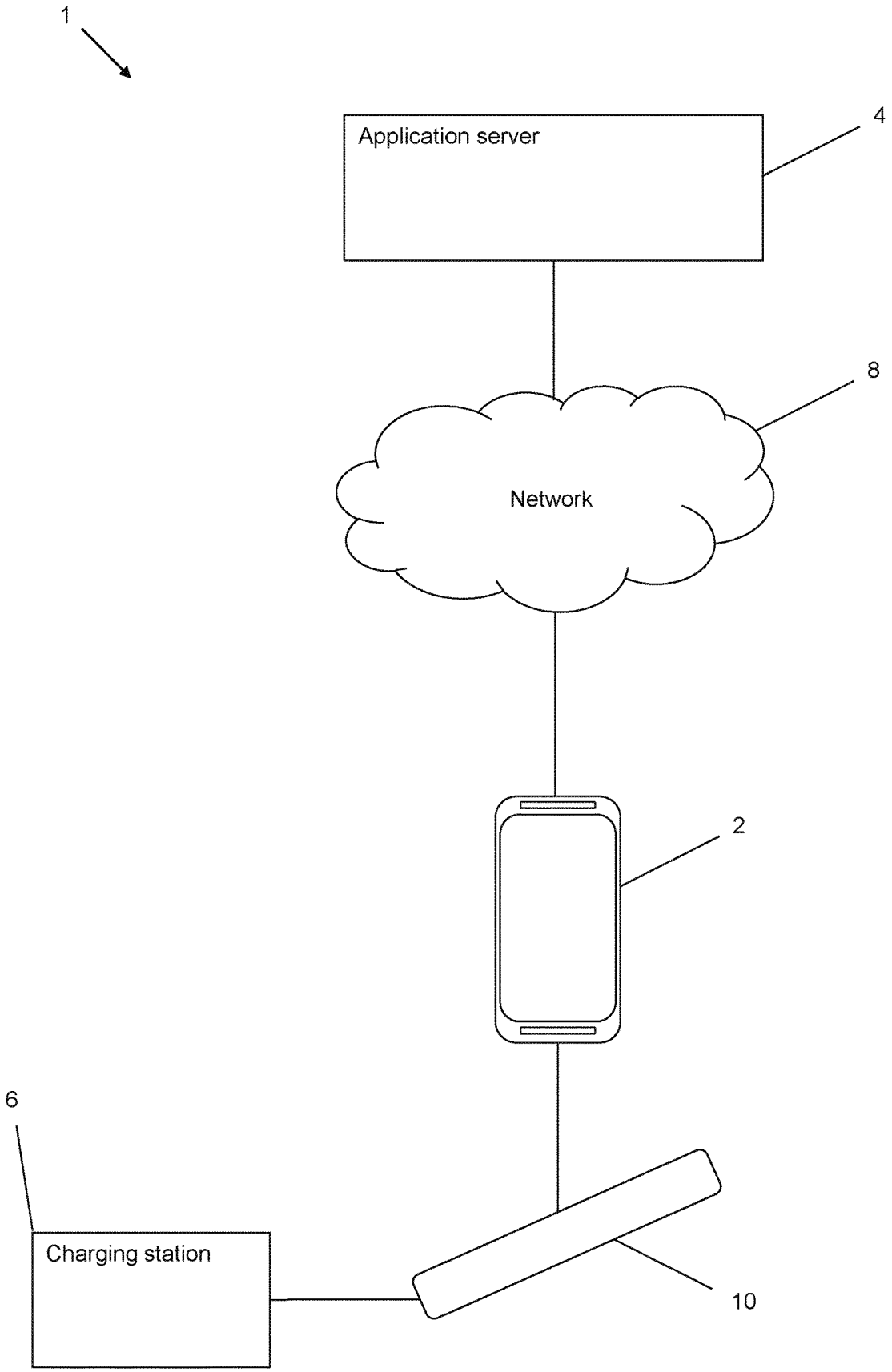
FIG. 1 shows an example system for managing a smoking substitute device.

FIG. 1 shows an example system 1 for managing a smoking substitute device 10.

The system 1 as shown in FIG. 1 includes a mobile device 2, an application server 4, an optional charging station 6, as well as the smoking substitute device 10.

The smoking substitute device 10 is configured to communicate wirelessly, e.g. via Bluetooth™, with an application (or "app") installed on the mobile device 2, e.g. via a suitable wireless interface (not shown) on the mobile device 2. The mobile device 2 may be a mobile phone, for example. The application on the mobile phone is configured to communicate with the application server 4, via a network 8. The application server 4 may utilise cloud storage, for example.

The network 8 may include a cellular network and/or the internet.

A skilled person would readily appreciate that the mobile device 2 may be configured to communicate via the network 8 according to various communication channels, preferably a wireless communication channel such as via a cellular network (e.g. according to a standard protocol, such as 3G or 4G) or via a WiFi network.

The app installed on the mobile device and the application server 4 may be configured to assist a user with their smoking substitute device 10, based on information communicated between the smoking substitute device 10 and the app and/or information communicated between the app and the application server 4.

The charging station 6 (if present) may be configured to charge (and optionally communicate with) the smoking substitute device 10, via a charging port on the smoking substitute device 10. The charging port on the smoking substitute device 10 may be a USB port, for example, which may allow the smoking substitute device to be charged by any USB-compatible device capable of delivering power to the smoking substitute device 10 via a suitable USB cable (in this case the USB-compatible device would be acting as the charging station 6). Alternatively, the charging station could be a docking station specifically configured to dock with the smoking substitute device 10 and charge the smoking substitute device 10 via the charging port on the smoking substitute device 10.

Figure 2A:
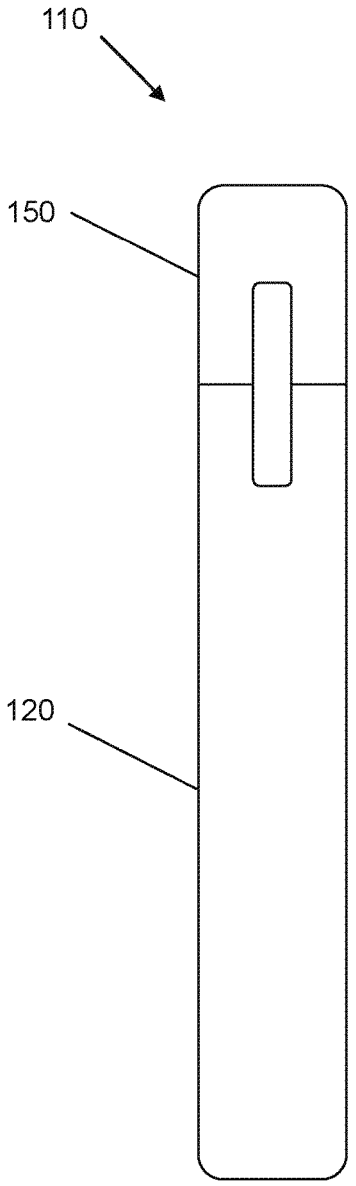
FIG. 2(*a*) shows an example smoking substitute device for use as the smoking substitute device in the system of FIG. 1.
Figure 2B:
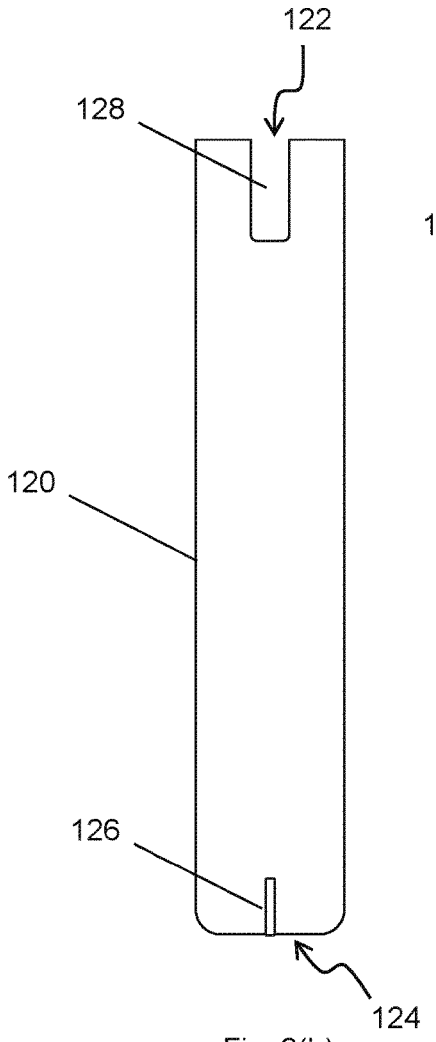
Figure 2C:
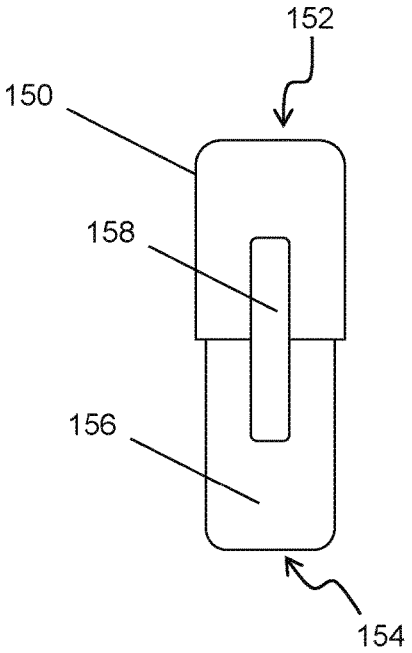

FIG. 2(*a*) shows an example smoking substitute device 110 for use as the smoking substitute device 10 in the system 1 of FIG. 1.

In this example, the smoking substitute device 110 includes a main body 120 and a consumable 150. The consumable 150 may alternatively be referred to as a "pod".

In this example, the smoking substitute device 110 is a closed system vaping device, wherein the consumable 150 includes a sealed tank 156 and is intended for one-use only.

FIG. 2(*a*) shows the smoking substitute device 110 with the main body 120 physically coupled to the consumable 150.

FIG. 2(*b*) shows the main body 120 of the smoking substitute device 110 without the consumable 150.

FIG. 2(*c*) shows the consumable 150 of the smoking substitute device 110 without the main body 120.

The main body 120 and the consumable 150 are configured to be physically coupled together, in this example by pushing the consumable 150 into an aperture in a top end 122 of the main body 120, e.g. with the consumable 150 being retained in the aperture via an interference fit. In other examples, the main body 120 and the consumable could be physically coupled together by screwing one onto the other, through a bayonet fitting, or through a snap engagement mechanism, for example. An optional light 126, e.g. an LED located behind a small translucent cover, is located a bottom end 124 of the main body 120. The light 126 may be configured to illuminate when the smoking substitute device 110 is activated.

The consumable 150 includes a mouthpiece (not shown) at a top end 152 of the consumable 150, as well as one or more air inlets (not shown in FIG. 2) so that air can be drawn into the smoking substitute device 110 when a user inhales through the mouthpiece. At a bottom end 154 of the consumable 150, there is located a tank 156 that contains e-liquid. The tank 156 may be a translucent body, for example.

The tank 156 preferably includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120.

In this present embodiment, the consumable 302 is a "single-use" consumable. That is, upon exhausting the e-liquid in the tank 156, the intention is that the user disposes of the whole consumable 150. In other embodiments, the e-liquid (i.e. aerosol former) may be the only part of the system that is truly "single-use". In such embodiments, the tank 156 may be refillable with e-liquid or the e-liquid may be stored in a non-consumable component of the system. For example, the e-liquid may be stored in a tank located in the device or stored in another component that is itself not single-use (e.g. a refillable tank).

The tank 156 may be referred to as a "clearomizer" if it includes a window 158, or a "cartomizer" if it does not.

Figure 3A:
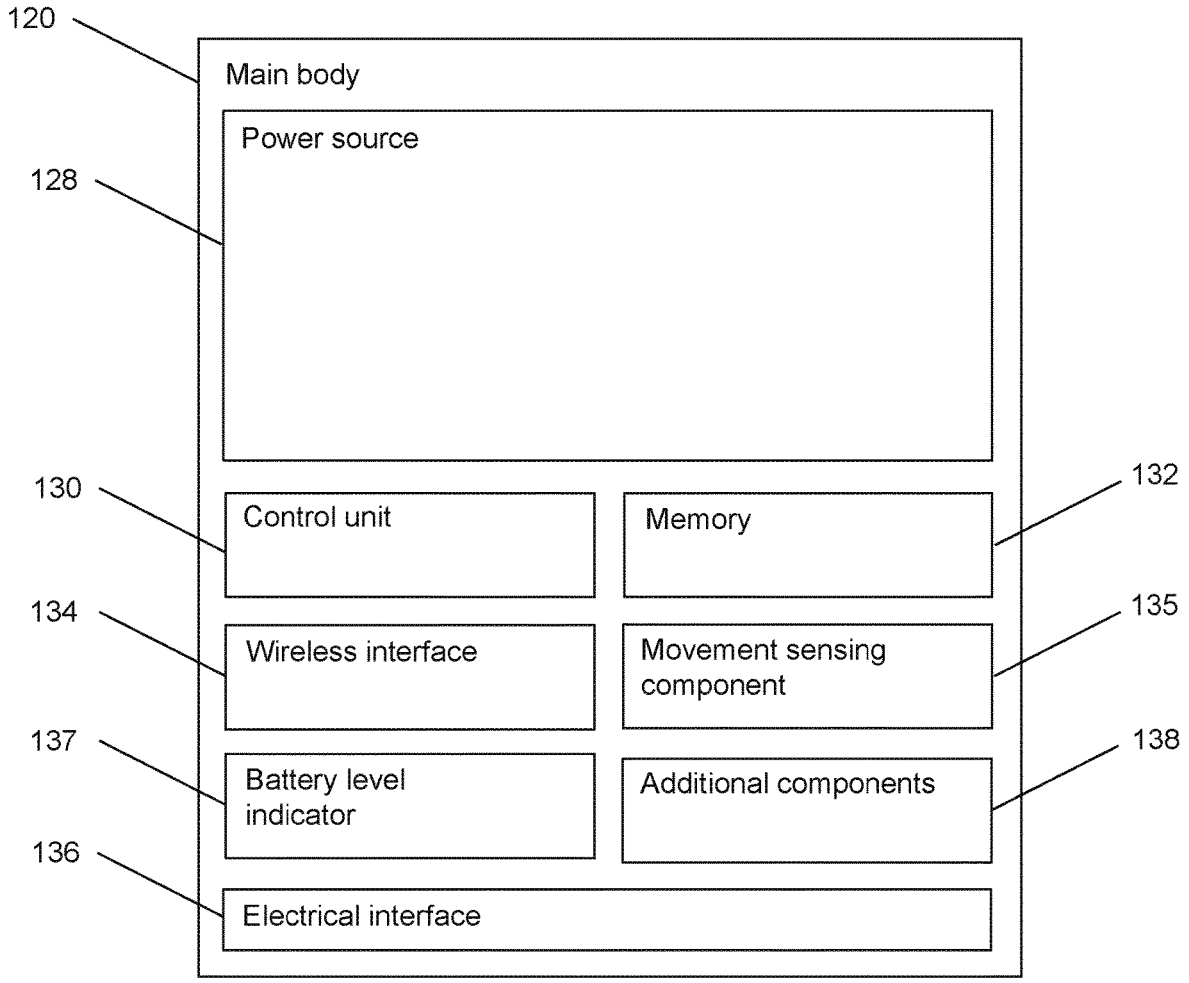
FIG. 3(*a*) is a schematic view of the main body of the smoking substitute device of FIG. 2(*a*).
Figure 3B:
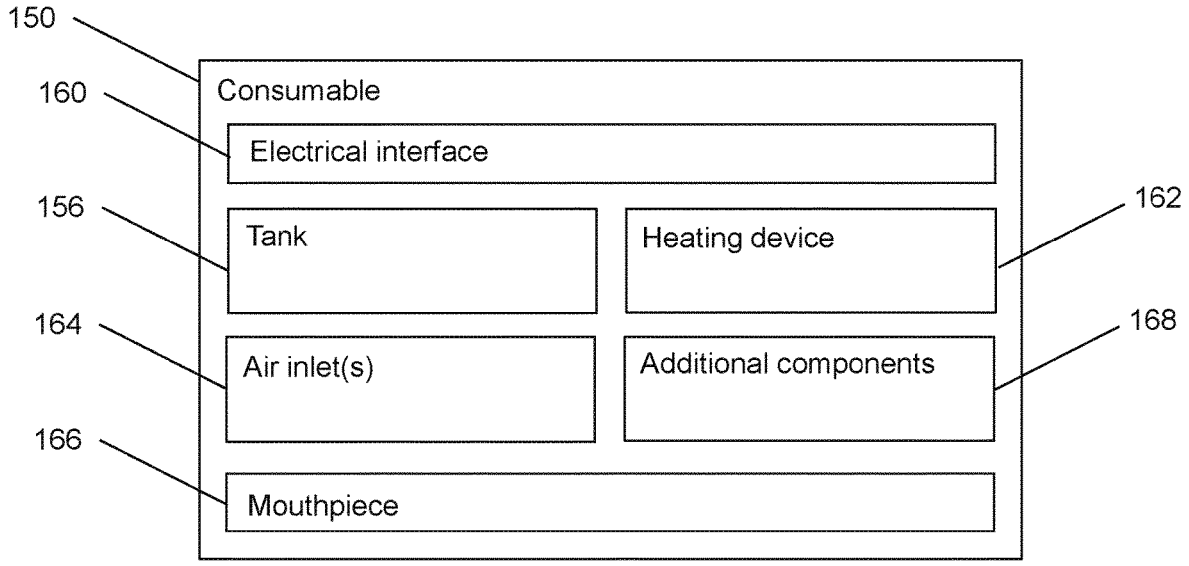

FIG. 3(*a*) is a schematic view of the main body 120 of the smoking substitute device 110.

FIG. 3(*b*) is a schematic view of the consumable 150 of the smoking substitute device 110.

As shown in FIG. 3(*a*), the main body 120 includes a power source 128, a control unit 130, a memory 132, a wireless interface 134, an electrical interface 136, and, optionally, one or more additional components 138.

The power source 128 is preferably a battery, more preferably a rechargeable battery. In the examples discussed below, the power source 128 is assumed to be a battery.

The control unit 130 may include a microprocessor, for example.

The memory 132 preferably includes non-volatile memory.

The wireless interface 134 is preferably configured to communicate wirelessly with the mobile device 2, e.g. via Bluetooth. To this end, the wireless interface 134 could include a Bluetooth™ antenna. Other wireless communication interfaces, e.g. WiFi, are also possible.

The electrical interface 136 of the main body 120 may include one or more electrical contacts. The electrical interface 136 may be located in, and preferably at the bottom of, the aperture in the top end 122 of the main body 120. When the main body 120 is physically coupled to the consumable 150, the electrical interface 136 may be configured to pass electrical power from the power source 128 to (e.g. a heating device of) the consumable 150 when the smoking substitute device 110 is activated, e.g. via the electrical interface 160 of the consumable 150 (discussed below). When the main body 120 is not physically coupled to the consumable 150, the electrical interface may be configured to receive power from the charging station 6.

The additional components 138 of the main body 120 may include the optional light 126 discussed above.

The additional components 138 of the main body 120 may, if the power source 128 is a rechargeable battery, include a charging port configured to receive power from the charging station 6. This may be located at the bottom end 124 of the main body 120. Alternatively, the electrical interface 136 discussed above is configured to act as a charging port configured to receive power from the charging station 6 such that a separate charging port is not required.

The additional components 138 of the main body 120 may, if the power source 128 is a rechargeable battery, include a battery charging control circuit, for controlling the charging of the rechargeable battery. However, a battery charging control circuit could equally be located in the charging station 6 (if present).

The additional components 138 of the main body 120 may include an airflow sensor for detecting airflow in the smoking substitute device 110, e.g. caused by a user inhaling through a mouthpiece 166 (discussed below) of the smoking substitute device 110. The smoking substitute device 110 may be configured to be activated when airflow is detected by the airflow sensor. This optional sensor could alternatively be included in the consumable 150 (though this is less preferred where the consumable 150 is intended to be disposed of after use, as in this example).

The additional components 138 of the main body 120 may include an actuator, e.g. a button. The smoking substitute device 110 may be configured to be activated when the actuator is actuated. This provides an alternative to the airflow sensor noted, as a mechanism for activating the smoking substitute device 110.

The additional components 138 of the main body 120 may include a reader configured to read information associated with the consumable from a machine readable data source included in (e.g. contained in the body of, or attached to) the consumable 150.

The reader may be configured to read information from the machine readable data source wirelessly, e.g. via electromagnetic waves or optically. Thus, for example, the machine readable data source included in the consumable 150 could be an RFID tag (in which case the reader included in the main body 120 may be an RFID reader) or a visual data source such as a barcode (in which case the reader included in the main body may be an optical reader, e.g. a barcode scanner). Various wireless technologies and protocols may be employed to allow the reader to wirelessly read information from a machine readable data source included in or attached to the consumable 150, e.g. NFC, Bluetooth, Wi-Fi, as would be appreciated by a skilled person.

For avoidance of any doubt, the reader (if present) may be configured to read information from the machine readable data source non-wirelessly, e.g. using a direct electrical connection between the main body 120 and consumable 150.

In the examples discussed below, the main body 120 also includes a movement sensing component 135, preferably an accelerometer, configured to sense movement of the smoking substitute device.

In the examples discussed below, the main body 120 also includes a battery level indicator 137 configured to, when activated, provide a visual indication of charge remaining in the battery. Other types of indication (e.g. haptic, audible) are of course possible, as discussed above.

As shown in FIG. 3(*b*), the consumable 150 includes the tank 156, an electrical interface 160, a heating device 162, one or more air inlets 164, a mouthpiece 166, and, optionally, one or more additional components 168.

The electrical interface 160 of the consumable 150 may include one or more electrical contacts. The electrical interface 136 of the main body 120 and an electrical interface 160 of the consumable 150 are preferably configured to contact each other and therefore electrically couple the main body 120 to the consumable 150 when the main body 120 is physically coupled to the consumable 150. In this way, electrical energy (e.g. in the form of an electrical current) is able to be supplied from the power source 128 in the main body 120 to the heating device 162 in the consumable 150.

The heating device 162 is preferably configured to heat e-liquid contained in the tank 156, e.g. using electrical energy supplied from the power source 128. In one example, the heating device 162 may include a heating filament and a wick, wherein a first portion of the wick extends into the tank 156 in order to draw e-liquid out from the tank 156, and wherein the heating filament coils around a second portion of the wick located outside the tank 156. In this example, the heating filament is configured to heat up e-liquid drawn out of the tank 156 by the wick to produce an aerosol vapour.

The one or more air inlets 164 are preferably configured to allow air to be drawn into the smoking substitute device 110, when a user inhales through the mouthpiece 166.

The additional components 168 of the consumable 150 may include a machine readable data source, which may e.g. be contained in the body of, or attached to the consumable 150. The machine readable data source may store information associated with the consumable. The information associated with the consumable may include information concerning the content of the consumable (e.g. e-liquid type, batch number) and/or a unique identifier, for example.

The machine readable data source may be rewritable, e.g. a rewritable RFID chip, or read only, e.g. a visual data source such as a barcode. As indicated above, the additional components 138 of the main body 120 may include a reader configured to read information associated with the consumable from the machine readable data source.

In use, a user activates the smoking substitute device 110, e.g. through actuating an actuator included in the main body 120 or by inhaling through the mouthpiece 166 as described above. Upon activation, the control unit 130 may supply electrical energy from the power source 128 to the heating device 162 (via electrical interfaces 136, 166), which may cause the heating device 162 to heat e-liquid drawn from the tank 156 to produce a vapour which is inhaled by a user through the mouthpiece 166.

Of course, a skilled reader would readily appreciate that the smoking substitute device 110 shown in FIGS. 2 and 3 is just one example implementation of a smoking substitute device, and that other forms of smoking substitute device could be used as the smoking substitute device 10 of FIG. 1.

By way of example, a HNB smoking substitute device including a main body and a consumable could be used as the smoking substitute device 10 of FIG. 1, instead of the smoking substitute device 110. One such HNB smoking substitute device is the IQOS™ smoking substitute device discussed above.

As another example, an open system vaping device which includes a main body, a refillable tank, and a mouthpiece could be used as the smoking substitute device 10 of FIG. 1, instead of the smoking substitute device 110. One such open system vaping device is the blu PRO™ e-cigarette discussed above.

As another example, an entirely disposable (one use) smoking substitute device could be used as the smoking substitute device 10 of FIG. 1, instead of the smoking substitute device 110.

Figure 4:
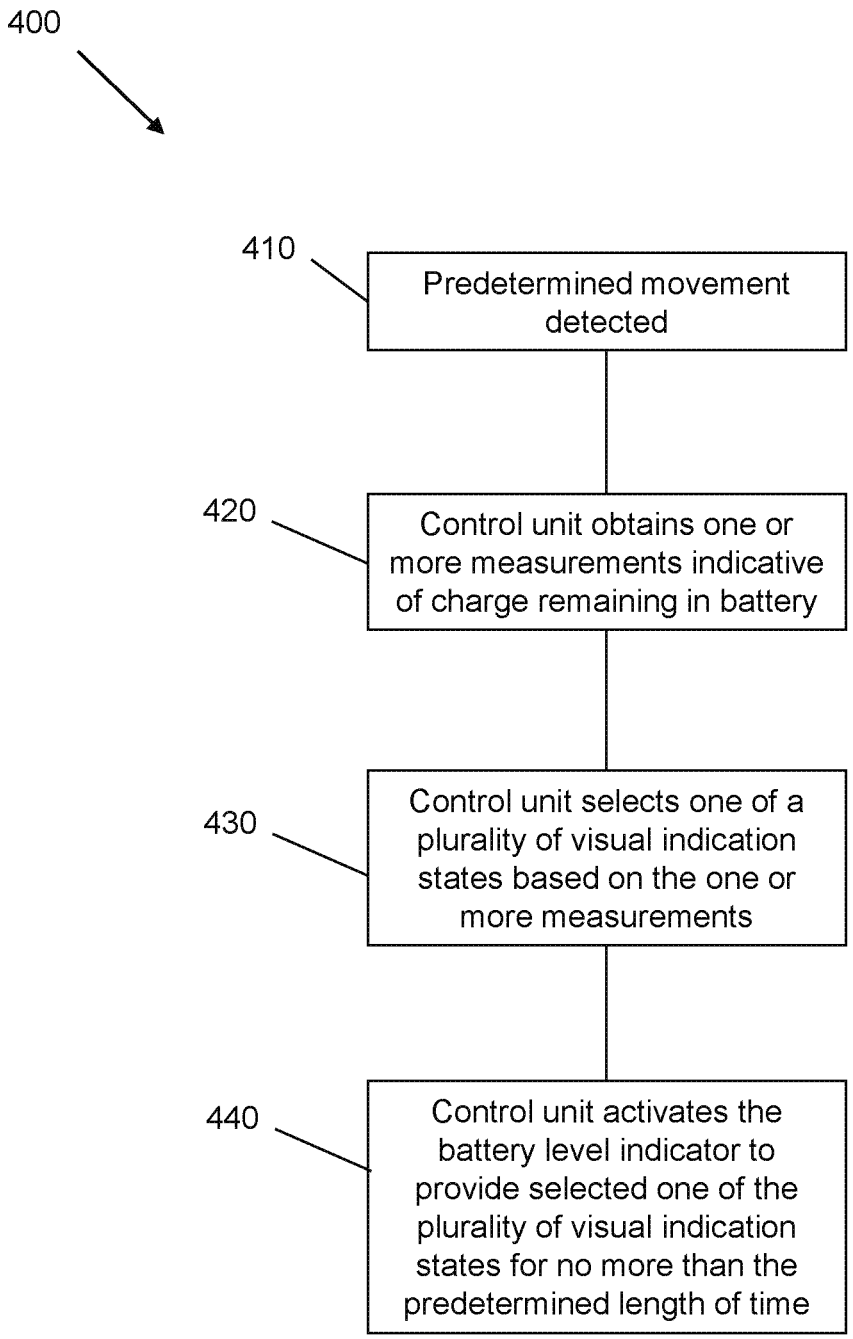
FIG. 4 is a flowchart of operations which may be performed by the smoking substitute device of FIG. 2(*a*).

FIG. 4 is a flowchart of operations which may be performed by the smoking substitute device 110 of FIG. 2(*a*).

At step 410 of method 400, a predetermined movement of the smoking substitute device 110 is detected using the movement sensing component 135. This predetermined movement may be a double tap, wherein the two taps of the double tap are performed within a predetermined "tap sequence" length of time (e.g. within 1 second).

The control unit 130 of the smoking substitute device 110 may continuously monitor for the predetermined movement, using the movement sensing component 135.

At step 420 of method 400, the control unit 130 obtains one or more measurements indicative of charge remaining in the battery 128, e.g. by obtaining a voltage produced by the battery 128 (e.g. using a voltage measuring component, which may be included as one of the additional components 138 in the main body 120 of the smoking substitute device 110).

At step 430 of method 400, the control unit 130 selects one of a plurality of visual indication state to be provided by the battery level indicator 137 (when activated by the control unit 130) based on the one or more measurements obtained by the control unit 130, wherein each visual indication state corresponds to a different amount of charge remaining in the battery 128.

The visual indication state may be selected using configuration information (e.g. a look-up table) stored on the smoking substitute device 110, wherein the configuration information stored on the smoking substitute device 110 provides a relationship between one or more measurements indicative of charge remaining in the battery 128 and the plurality of visual indication states.

At step 440 of method 400, the control unit 130 activates the battery level indicator 137 to provide the selected one of the plurality of visual indication states on the smoking substitute device 110, preferably for no more than a predetermined length of time. The pre-determined length of time may be 30 seconds or less, 20 seconds or less, 10 seconds or less, or 5 seconds or less, for example.

In this way, a user can obtain a visual indication of charge remaining in the battery 128 when needed (by performing the predetermined movement), whilst avoiding using up battery 128 by providing the visual indication when the user does not need an indication of charge remaining in the battery 128.

Figure 5:
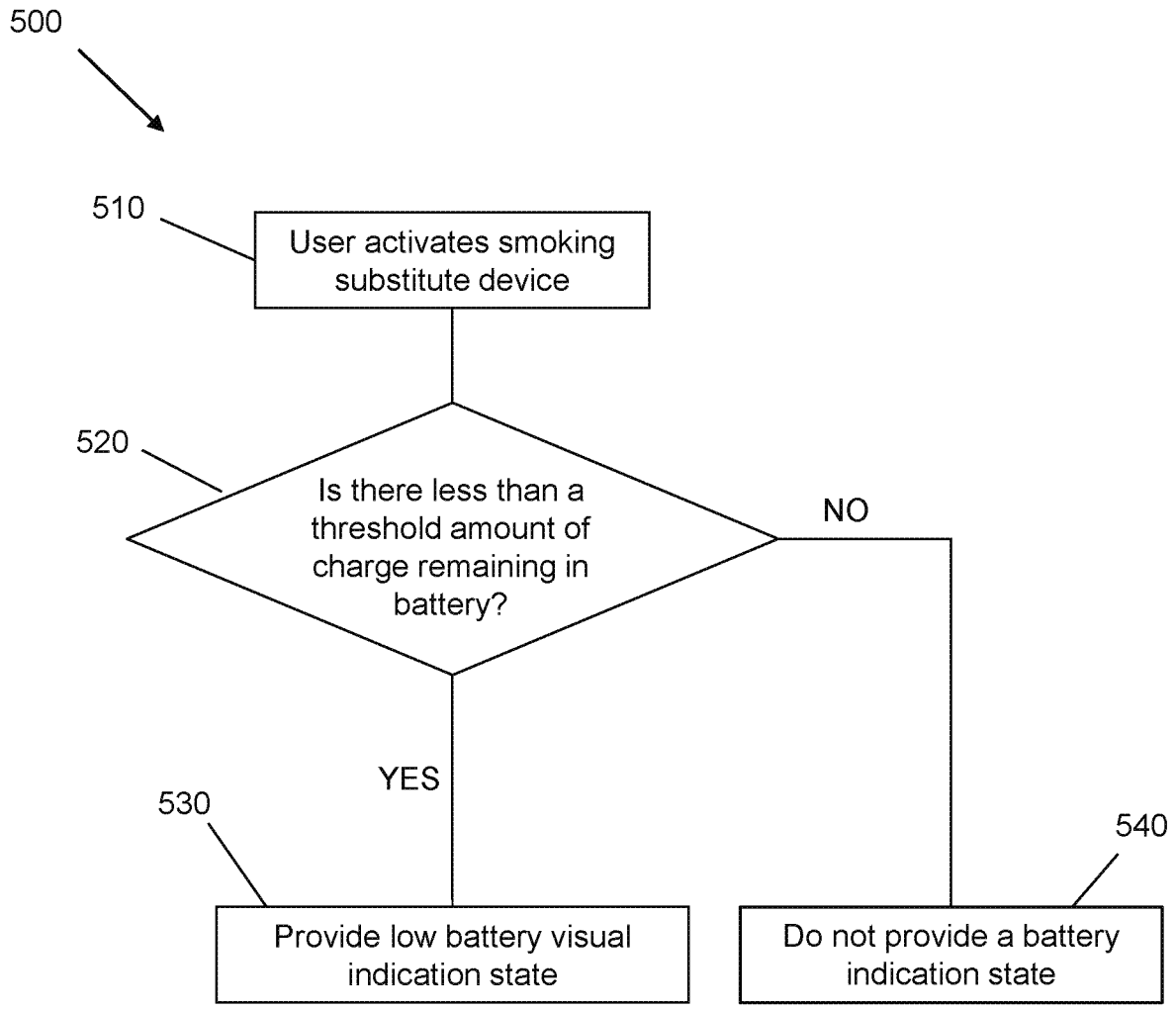
FIG. 5 is another flowchart of operations which may be performed by the smoking substitute device of FIG. 2(*a*).

FIG. 5 is another flowchart of operations which may be performed by the smoking substitute device 110 of FIG. 2(*a*).

At step 510 of method 500, the user activates the smoking substitute device 110, e.g. through actuating an actuator included in the main body 120 or by inhaling through the mouthpiece 166 as described above.

At step 520 of method 500, the control unit 130 determines whether there is less than a threshold amount of charge remaining in the battery, e.g. using configuration information as described above.

If there is less than a threshold amount of charge remaining in the battery ("YES" of step 520), then at step 530 of method 500 the control unit 130 activates the battery level indicator 137 to provide a low battery visual indication state.

If there is not less than a threshold amount of charge remaining in the battery ("NO" of step 520), then at step 540 of method 500 no visual indication state is provided by the battery level indicator 137 (unless the predetermined movement described in relation to FIG. 4 is performed).

Figure 6:
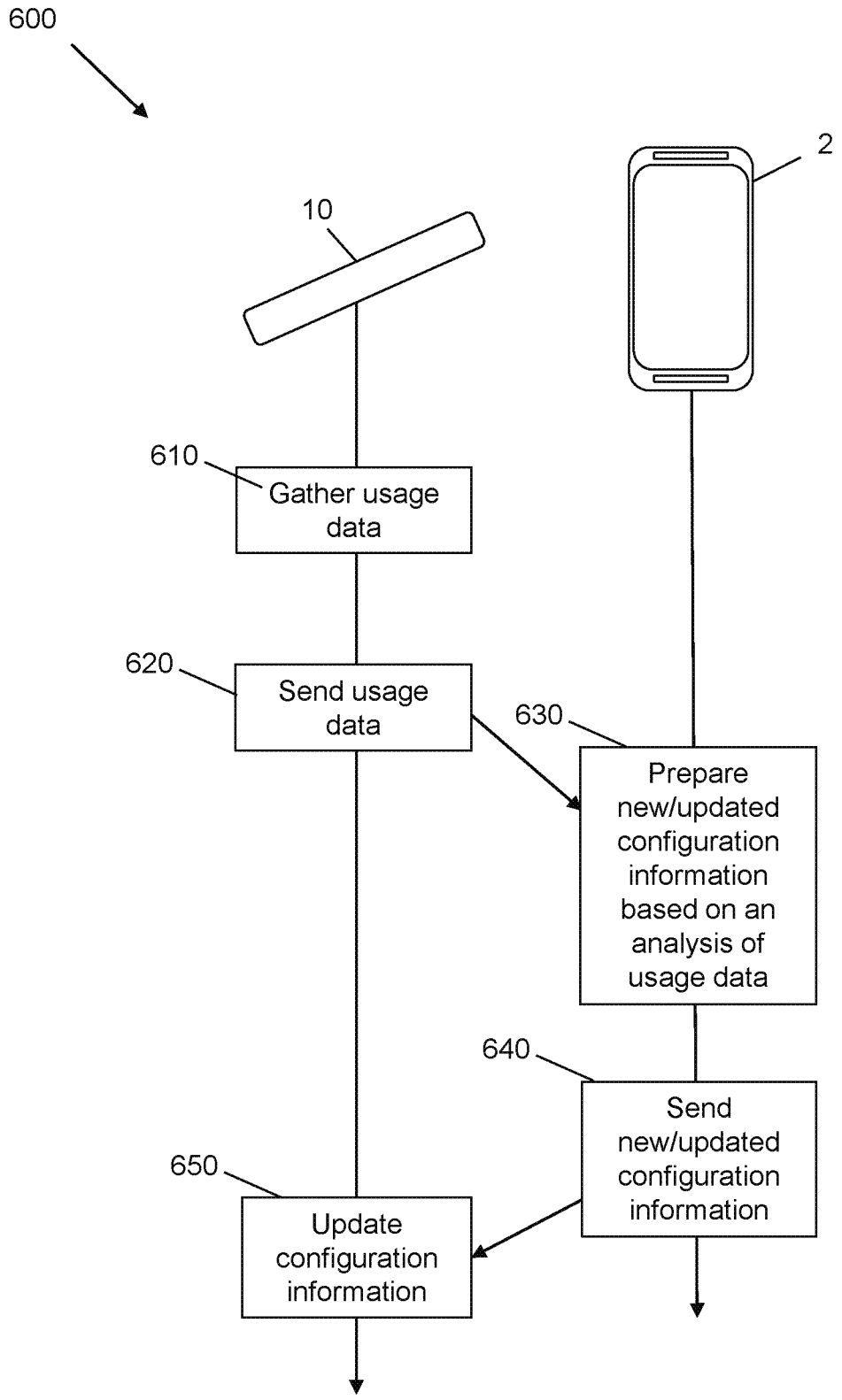
FIG. 6 is another flowchart of operations which may be performed by the smoking substitute device of FIG. 2(*a*) in combination with the mobile device of FIG. 1.

FIG. 6 is a flowchart of operations which may be performed by the smoking substitute device 110 of FIG. 2(*a*) in combination with the mobile device 2 of FIG. 1.

At step 610 of method 600, the smoking substitute device 110 gathers usage data, i.e. data concerning how the smoking substitute device 110 has been used by a user of the smoking substitute device 110.

At step 620 of method 600, this usage data is then sent (e.g. periodically, or on request by the user) to the application on the mobile device 2.

At step 630 of method 600, the application prepares new/updated configuration information (which provides a relationship between one or more measurements indicative of charge remaining in the battery 128 to the plurality of visual indication states) based on an analysis of the usage data.

At step 640 of method 600, the application sends the new/updated configuration information to the smoking substitute device 110

At step 650 of method 600, the control unit 130 of the smoking substitute device 110 updates the configuration information stored on the smoking substitute device based on the new/updated configuration information it receives from the application, e.g. by replacing existing configuration information with the new/updated configuration information.

Figures 7A, 7B, 7C, 7D:
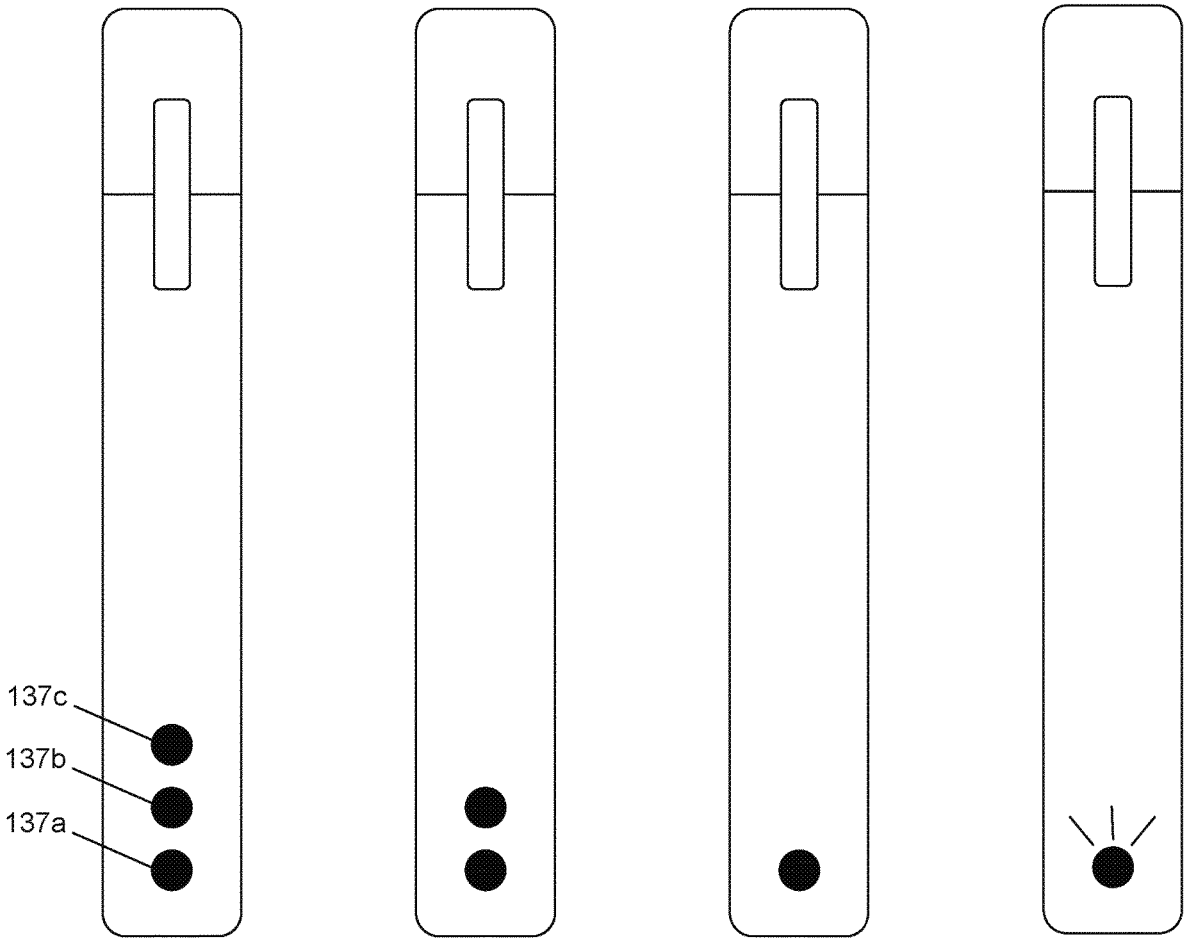
FIGS. 7(*a*)-(*d*) depict example visual indication states provided by an example battery level indicator.

FIGS. 7(*a*)-(*d*) depict example visual indication states provided by an example battery level indicator 137.

In this example, the battery level indicator 137 includes three lights arranged on the smoking substitute device 110, labelled on FIG. 7(*a*) as 137*a*, 137*b*, 137*c*.

FIG. 7(*a*) shows a first visual indication state which, in this example, corresponds to a first estimated number of (e.g. 200 or more) remaining activations that can be performed by the smoking substitute device 110 before the smoking substitute device 110 becomes inoperable due to a lack of battery charge. Thus, if the first visual indication state is provided by the battery level indicator 137, a user knows that the battery 128 contains enough charge for at least the first estimated number of activations of the smoking substitute device 110. In this example, all three lights 137*a*, 137*b*, 137*c* are illuminated continuously in the first visual indication state. The three lights 137*a*, 137*b*, 137*c* are preferably illuminated continuously for no longer than a pre-determined length of time, e.g. as described with reference to FIG. 4.

FIG. 7(*b*) shows a second visual indication state which, in this example, corresponds to a second estimated number of (e.g. 80 or more) remaining activations that can be performed by the smoking substitute device 110 before the smoking substitute device 110 becomes inoperable due to a lack of battery charge. Thus, if the second visual indication state is provided by the battery level indicator 137, a user knows that the battery 128 contains enough charge for at least the second estimated number activations of the smoking substitute device 110. In this example, two of the lights 137*a*, 137*b* are illuminated continuously in the second visual indication state. The two lights 137*a*, 137*b* are preferably illuminated continuously for no longer than a pre-determined length of time, e.g. as described with reference to FIG. 4.

FIG. 7(*c*) shows a third visual indication state which, in this example, corresponds to a third estimated number of (e.g. 30 or more) remaining activations that can be performed by the smoking substitute device 110 before the smoking substitute device 110 becomes inoperable due to a lack of battery charge. Thus, if the third visual indication state is provided by the battery level indicator 137, a user knows that the battery 128 contains enough charge for at least the third estimated number activations of the smoking substitute device 110. In this example, one of the lights 137*a* is illuminated continuously in the third visual indication state. The light 137*a* is preferably illuminated continuously for no longer than a pre-determined length of time, e.g. as described with reference to FIG. 4.

FIG. 7(*d*) shows a fourth visual indication state which, in this example, corresponds to a fourth estimated number of (e.g. 10 or less) remaining activations that can be performed by the smoking substitute device 110 before the smoking substitute device 110 becomes inoperable due to a lack of battery charge. Thus, if the fourth visual indication state is provided by the battery level indicator 137, a user knows that the battery 128 contains enough charge for no more than the fourth estimated number activations of the smoking substitute device 110. In this example, one of the lights 137*a* is illuminated discontinuously (turns repeatedly on and off) in the fourth visual indication state. The light 137*a* is preferably illuminated discontinuously for no longer than a pre-determined length of time, e.g. as described with reference to FIG. 4.

If a user performs the predetermined motion using the smoking substitute device 110, then the control unit may activate the battery level indicator 137 to provide the appropriate visual indication state, in accordance with the process described with reference to FIG. 4.

The fourth visual indication state noted above may correspond to the low battery visual indication state referred to above.

Thus, if the control unit 130 determines that there is less than a threshold amount of charge remaining in the battery 128, e.g. using configuration information as described above, then the fourth visual indication state may be provided by the battery level indicator 137 upon a user activating the smoking substitute device 110, even if the user does not perform the predetermined movement, e.g. as described above with reference to FIG. 5.

Figure 8:
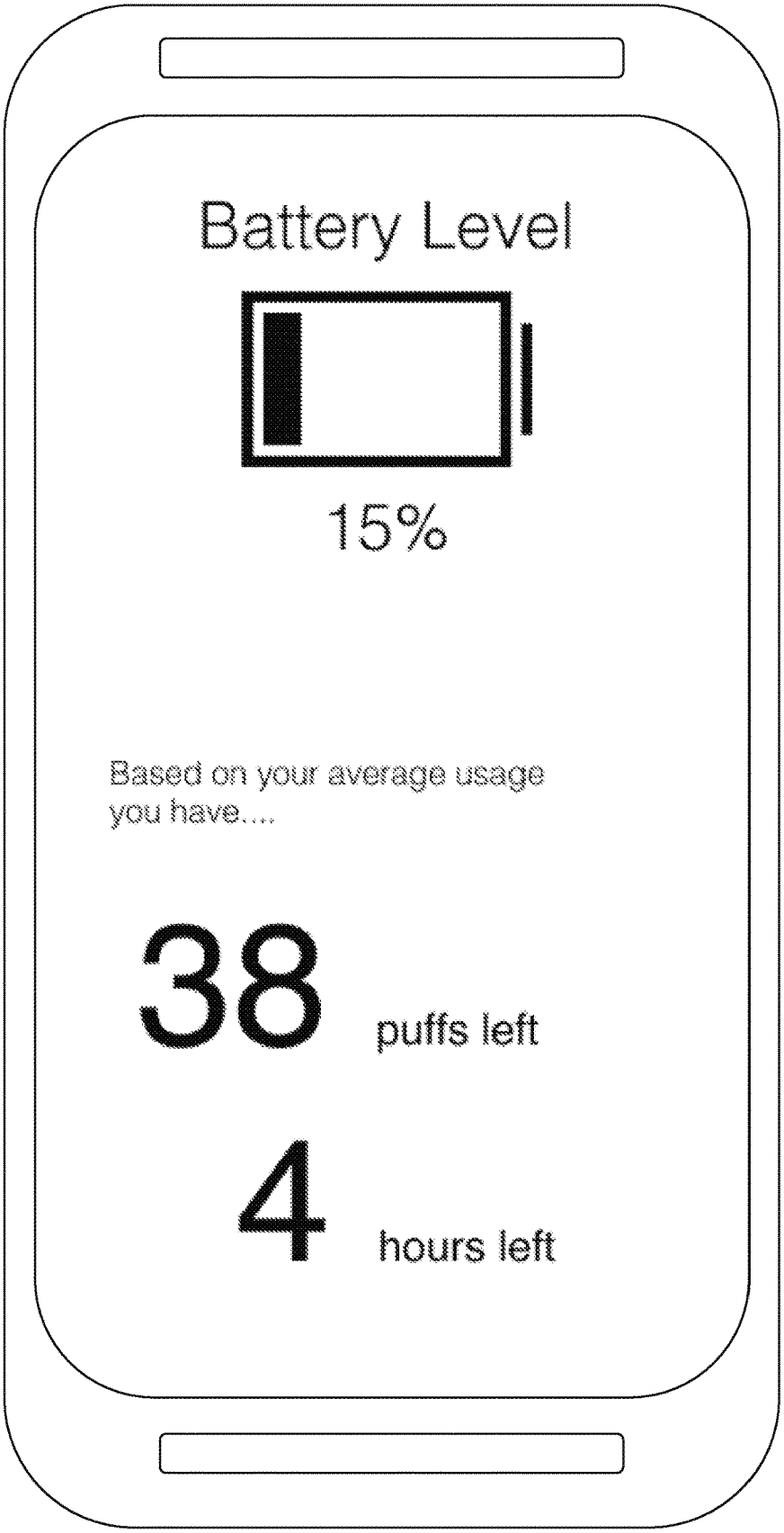
FIG. 8 depicts the mobile phone of FIG. 1 displaying information concerning the battery of the smoking substitute device.

FIG. 8 depicts the mobile phone 2 of FIG. 1 displaying information concerning the battery 128 of the smoking substitute device 110.

The application may be configured to display this information on a screen of the mobile device 2, based on one or more measurements indicative of charge remaining in the battery 128 of the smoking substitute device 110 and obtained by (e.g. a control unit 130 of) the smoking substitute device 110, wherein the one or more measurements have been wirelessly communicated by the smoking substitute device 110 to the application on the mobile device 2.

The information concerning the battery 128 of the smoking substitute device 110 displayed on the screen of the mobile device 2 may include a battery level indication, e.g. expressed as a percentage.

The information concerning the battery 128 of the smoking substitute device 110 displayed on the screen of the mobile device 2 may include an estimated number of remaining activations that can be performed by the smoking substitute device 110 before the smoking substitute device 110 becomes inoperable due to a lack of battery charge (e.g. expressed as "puffs left").

The estimated number of remaining activations is preferably calculated by the application in a manner that is dependent on usage data concerning how the smoking substitute device 110 has been used by a user of the smoking substitute device 110, e.g. as described elsewhere herein.

The information concerning the battery 128 of the smoking substitute device 110 displayed on the screen of the mobile device 2 may include an estimated amount of time remaining before the smoking substitute device 110 becomes inoperable due to a lack of battery charge.

The estimated time remaining is preferably calculated by the application in a manner that is dependent on usage data concerning how the smoking substitute device has been used by a user of the smoking substitute device 110.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention. For example, instead of visual indications of charge remaining (as in the examples discussed above), haptic or audible indications would equally be possible.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

The invention claimed is:

1. A smoking substitute device having:

a control unit;

a battery configured to supply power to the smoking substitute device;

a movement sensing component configured to sense movement of the smoking substitute device; and a battery level indicator configured to, when activated, provide an indication of charge remaining in the battery;

wherein the control unit is configured to activate the battery level indicator, when a predetermined movement of the smoking substitute device is detected using the movement sensing component;

wherein the control unit is configured to obtain one or more measurements indicative of charge remaining in the battery, and to select an indication state to be provided by the battery level indicator based on the one or more measurements;

wherein the control unit is configured such that the selection of an indication state by the control unit uses configuration information stored on the smoking substitute device, wherein the configuration information stored on the smoking substitute device provides a relationship between one or more measurements indicative of charge remaining in the battery and the plurality of indication states;

wherein the configuration information stored on the smoking substitute device is configured to be updated based on data concerning how the smoking substitute device has been used by a user of the smoking substitute device.

2. A smoking substitute device according to claim 1, wherein the control unit is configured to activate the battery level indicator for no more than a predetermined length of time, when the predetermined movement of the smoking substitute device is detected using the movement sensing component.

3. A smoking substitute device according to claim 2, wherein the predetermined length of time is 10 seconds or less.

4. A smoking substitute device according to claim 1, wherein the predetermined movement detected using the movement sensing component detected using the movement sensing component includes a sequence of taps of the smoking substitute device performed within a predetermined tap sequence length of time.

5. A smoking substitute device according to claim 1, wherein the battery level indicator is configured to, when activated, provide a visual indication of charge remaining in the battery.

6. A smoking substitute device according to claim 1, wherein:

the battery level indicator is configured to, when activated, provide an indication of charge remaining in the battery by operating in one of a plurality of indication states, wherein each indication state corresponds to a different amount of charge remaining in the battery;

the control unit is configured to activate the battery level indicator to provide one of the plurality of indication states for no more than the predetermined length of time, when a predetermined movement of the smoking substitute device is detected using the movement sensing component.

7. A smoking substitute device according to claim 6, wherein each indication state corresponds to a different estimated number of remaining activations that can be performed by the smoking substitute device before the smoking substitute device becomes inoperable due to a lack of battery charge.

8. A smoking substitute device according to claim 1, wherein the control unit is configured such that the selection of an indication state by the control unit is dependent on usage data concerning how the smoking substitute device has been used by a user of the smoking substitute device.

9. A smoking substitute device according to claim 1 wherein each indication state corresponds to a different estimated number of remaining activations that can be performed by the smoking substitute device before the smoking substitute device becomes inoperable due to a lack of battery charge, and the configuration information is configured to be updated based on data concerning the length of time the user typically activates their smoking substitute device per activation.

10. A smoking substitute device according to claim 1, wherein the control unit is configured to update the configuration information stored on the smoking substitute device based on new/updated configuration information received from an application on a mobile device wirelessly connected to the smoking substitute device, wherein the application on the mobile device has prepared the new/updated configuration information based on an analysis of data concerning how the smoking substitute device has been used by a user of the smoking substitute device.

11. A smoking substitute device according to claim 1, wherein the battery level indicator is configured to, when activated, provide an indication of charge remaining in the battery by operating in one of a plurality of indication states, wherein each indication state corresponds to a different amount of charge remaining in the battery, wherein the plurality of indication states includes a low battery indication state indicating that there is less than a predetermined threshold amount of charge remaining in the battery.

12. A smoking substitute device according to claim 11, wherein the control unit is configured to, when it determines that there is less than the threshold amount of charge remaining in the battery, activate the battery level indicator to provide the low battery indication state when a user activates the smoking substitute device.

13. A smoking substitute device according to claim 1, wherein the battery level indicator is configured to, when activated, provide an indication of charge remaining in the battery by operating in one of a plurality of visual indication states, wherein each visual indication state corresponds to a different amount of charge remaining in the battery, and the battery level indicator includes a plurality of lights configured to provide the plurality of the visual indication states.

14. A system for managing a smoking substitute device, the system including:

a smoking substitute device;

a mobile device;

wherein the smoking substitute device has:

a control unit;

a battery configured to supply power to the smoking substitute device;

a movement sensing component configured to sense movement of the smoking substitute device; and a battery level indicator configured to, when activated, provide an indication of charge remaining in the battery;

wherein the control unit is configured to activate the battery level indicator, when a predetermined movement of the smoking substitute device is detected using the movement sensing component;

wherein the control unit is configured to obtain one or more measurements indicative of charge remaining in the battery, and to select an indication state to be provided by the battery level indicator based on the one or more measurements;

wherein the control unit is configured such that the selection of an indication state by the control unit uses configuration information stored on the smoking substitute device, wherein the configuration information stored on the smoking substitute device provides a relationship between one or more measurements indicative of charge remaining in the battery and the plurality of indication states;

wherein the configuration information stored on the smoking substitute device is configured to be updated based on data concerning how the smoking substitute device has been used by a user of the smoking substitute device;

wherein the smoking substitute device is configured to communicate wirelessly with an application installed on the mobile device.

15. A system according to claim 14, wherein the application is configured to display on a screen of the mobile device information concerning the battery of the smoking substitute device, based on one or more measurements indicative of charge remaining in the battery obtained by the smoking substitute device that have been wirelessly communicated by the smoking substitute device to the application on the mobile device.

16. A system according to claim 14, wherein:

the application is configured to prepare new/updated configuration information, which provides a relationship between one or more measurements indicative of charge remaining in the battery to the plurality of indication states, based on an analysis of data concerning how the smoking substitute device has been used by a user of the smoking substitute device, and to send the new/updated configuration information to the smoking substitute device;

the control unit is configured to update the configuration information stored on the smoking substitute device based on the new/updated configuration information received from the application.

17. A smoking substitute device having:

a control unit;

a battery configured to supply power to the smoking substitute device;

a movement sensing component configured to sense movement of the smoking substitute device; and a battery level indicator configured to, when activated, provide an indication of charge remaining in the battery;

wherein the control unit is configured to activate the battery level indicator, when a predetermined movement of the smoking substitute device is detected using the movement sensing component;

wherein the control unit is configured to obtain one or more measurements indicative of charge remaining in the battery, and to select an indication state to be provided by the battery level indicator based on the one or more measurements;

wherein the control unit is configured such that the selection of an indication state by the control unit is dependent on usage data concerning how the smoking substitute device has been used by a user of the smoking substitute device.

18. A smoking substitute device according to claim 17, wherein the control unit is configured such that the selection of an indication state by the control unit uses configuration information stored on the smoking substitute device, wherein the configuration information stored on the smoking substitute device provides a relationship between one or more measurements indicative of charge remaining in the battery and the plurality of indication states.

19. A smoking substitute device according to claim 18, wherein the configuration information stored on the smoking substitute device is configured to be updated based on data concerning how the smoking substitute device has been used by a user of the smoking substitute device.

* * * * *